United States Patent [19]

Parsons, Sr.

[11] 3,993,008

[45] Nov. 23, 1976

[54] POWER LIFT FOR A SEWING MACHINE HEAD

[76] Inventor: Joe T. Parsons, Sr., 1200 W. Hale, Osceola, Ark. 72370

[22] Filed: Nov. 24, 1975

[21] Appl. No.: 634,924

[52] U.S. Cl. ..... 112/217.1

[51] Int. Cl.[2] ..... D05B 75/02

[58] Field of Search ..... 112/217.1, 258; 312/21, 312/29, 306; 5/63; 108/147

[56] References Cited

UNITED STATES PATENTS

| | | | |
|---|---|---|---|
| 2,870,460 | 1/1959 | Sanford | 5/63 |
| 3,050,744 | 8/1962 | Mann et al. | 5/63 |
| 3,220,019 | 11/1965 | Nelson | 5/67 |
| 3,644,945 | 2/1972 | Goodman et al. | 5/68 |
| 3,870,386 | 3/1975 | Shepherd | 312/21 X |

FOREIGN PATENTS OR APPLICATIONS

| | | | |
|---|---|---|---|
| 498,884 | 9/1954 | Italy | 312/21 |

*Primary Examiner*—George H. Krizmanich
*Attorney, Agent, or Firm*—John R. Walker, III

[57] ABSTRACT

A sewing cabinet which includes provisions for electrically carrying a typical sewing machine head between a concealed/stowed position and at least one working position. The structure includes a carriage assembly having a platform which restingly supports the head. Peculiar structure is included for stabilizing the platform in various positions and for driving the carriage assembly therebetween. In one embodiment the carriage assembly is stabilized by a plurality of fixed upright rods which are slidably engaged by sleeve structure affixed to the carriage assembly. In this embodiment the carriage assembly is driven by a single upright externally threaded shaft protruding directly upward from a motor with internally threaded structure being affixed to the carriage assembly and threadedly engaging the shaft to selectively drive the carriage assembly up or down. In another embodiment the carriage assembly is stabilized by a plurality of externally threaded power driven mandrels. Each mandrel is threadedly engaged by a yoke which is affixed to the carriage assembly, i.e., each yoke includes an upper and lower internally threaded stabilizing control member, which provides considerable stability to the carriage assembly. These mandrels are coupled to a motor whereby selective rotation in unison thereof in forward or reverse directions respectively drives the carriage assembly up or down.

14 Claims, 9 Drawing Figures

POWER LIFT FOR A SEWING MACHINE HEAD

BACKGROUND OF THE INVENTION

1. Field of the Invention:

This invention relates to the field of cabinets for housing typical sewing machine heads and is particularly directed toward power operated structure for moving the sewing machine head between a stowed position and at least one working position.

2. Description of the Prior Art:

The typical sewing machine cabinet includes suitable structure for swingingly moving the head between the concealed/stowed position and the working position. In other words, the typical cabinet includes a well for housing the machine head and when it is desired to bring the machine head into an operating or working position, it is simply manually lifted from the well and placed in the working position. Many persons who are otherwise capable of operating the sewing machine head are unable to manually lift this heavy machine head to bring it into the operating position. The difficulty these people experience in lifting the machine head is particularly significant with free arm or open arm sewing machine heads since they have two operating or working positions, i.e., one working position is achieved by fully lifting the machine head upwardly to expose an open arm which is intended to receive sleeves or the like while another position is achieved by supporting the head partially within the well so that the upper flat surface of the free arm is in alignment with the working surface of the sewing machine cabinet, this latter position is commonly known as flatbed sewing while the former position is commonly referred to as open arm sewing.

Also, there has heretofore been a vertically movable sewing machine head that operated against a coil spring when it was pushed down and moved upwardly under the influence of the spring action. There was a manually actuated plunger engageable in a slot to hold the head at the desired level.

There were problems with certain of the prior sewing machine cabinets in that the machine heads were not adequately stabilized, therefore the moving parts often became jammed. Additionally, persons performing the task of moving the sewing machine head between these positions often experienced pinched fingers as a result of their getting caught between certain moving structure.

SUMMARY OF THE INVENTION

The present invention is directed towards overcoming the disadvantages and problems relative to prior sewing machine cabinets. The concept of the present invention is to provide a sewing machine cabinet or a device which includes provisions for electrically carrying a typical sewing machine head between a concealed/stowed position and at least one working position. The device includes a carriage assembly having a platform which restingly supports the head. Means are included to accomodate flatbed sewing or free arm (open arm) sewing, i.e., the platform has two operating levels or two working positions, one for flatbed sewing and another for free arm sewing. The device includes peculiar structure for stabilizing the platform in these various positions and for driving the carriage assembly therebetween. In one embodiment the carriage assembly is stabilized by a plurality of fixed upright rods which are slidably engaged by sleeve structure affixed to the carriage assembly. In this embodiment the carriage assembly is driven by a single upright externally threaded shaft protruding directly upward from a motor with internally threaded structure being affixed to the carriage assembly and threadedly engaging the shaft to selectively drive the carriage assembly up or down. In another embodiment the carriage assembly is stabilized by a plurality of externally threaded power driven mandrels. Each mandrel is threadedly engaged by a yoke which is affixed to the carriage assembly, i.e., each yoke includes an upper and lower internally threaded stabilizing control member which provides considerable stability to the carriage assembly. These mandrels are coupled to a motor whereby selective rotation in unison thereof in forward or reverse directions respectively drives the carriage assembly up or down.

DESCRIPTION OF THE PREFERRED EMBODIMENT

Figure 1:
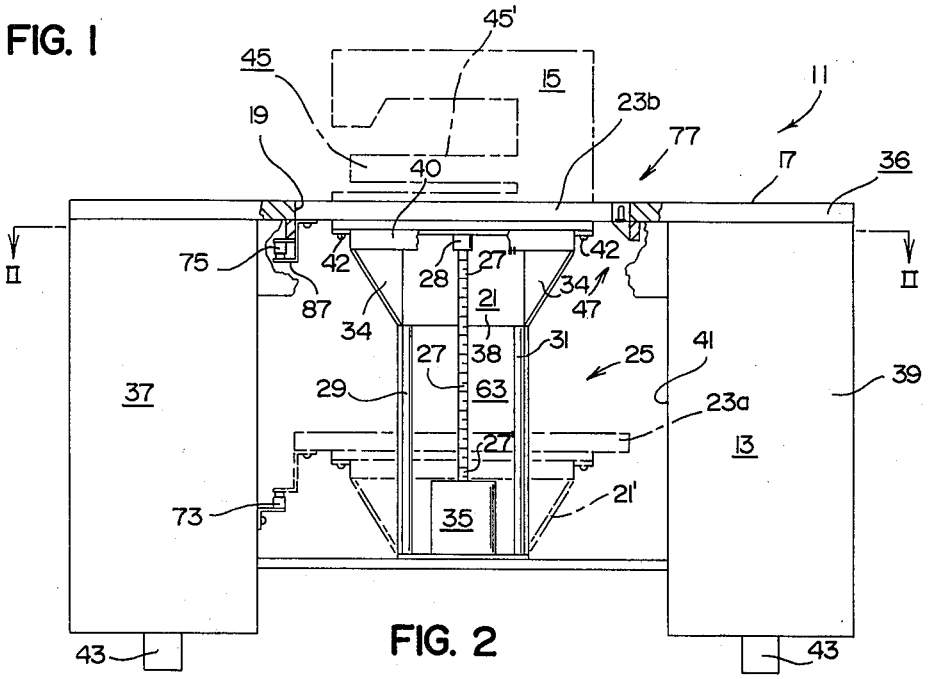
FIG. 1 is a front elevational view of the sewing machine cabinet of the present invention depicting a typical sewing machine head in phantom lines suitably attached thereto and showing a portion of the cabinet broken away to better illustrate certain structure of the cabinet. Also certain structure of the cabinet is depicted in phantom lines to illustrate the movement thereof.

The power lift 11 of the present invention is intended for use with a sewing machine of the type having a desklike cabinet 13, a concealable sewing machine head 15 and a horizontally disposed work surface 17 provided with a head opening 19 through which the sewing machine head 15 may freely be passed. The power lift 11 generally includes a carriage assembly 21 carrying a platform 23 having a size and shape complementary with the opening 19 for restingly supporting thereon the sewing machine head 15.

Figure 3:
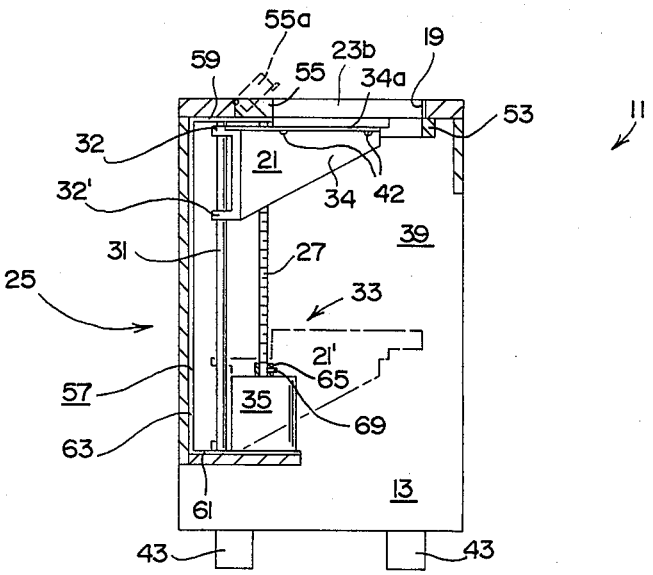
FIG. 3 is a sectional view taken as on the line III—III of FIG. 2 with the movement of certain structure being depicted in phantom lines.

From FIGS. 1 and 3 of the drawings it may be seen that the platform 23 is movable between a concealed/stowed position beneath the work surface 17 and at least one working position wherein a cooperative association of the sewing machine head 15 and the work surface 17 is established, i.e., the sewing machine head 15 as shown in FIG. 1 of the drawings is restingly supported on the platform 23 with the carriage assembly being shown in solid lines thus establishing one of the working positions which may simply be designated by the numeral 21 and the carriage assembly is depicted in phantom lines thus establishing the concealed/stowed position and characterized therein by the numeral 21'. The power lift or device 11 of the present invention also includes platform stabilizing/motive means, as at 25, for guidingly constraining the carriage assembly 21 through the movement thereof and for selectively driving the carriage assembly 21 between the concealed/-stowed position 21' and the above-mentioned working positions.

The platform stabilizing/motive means 25 generally includes a plurality of elongated upright shaft members 27, 29, 31, a plurality of restraining members 28, 30, 32 attached to the carriage assembly 21 for restrainedly coupling the carriage assembly 21 with the respective plurality of shaft members 27, 29, 31. At least one of the shaft members e.g., the shaft member 27, is provided with external threads substantially along the length thereof and at least one of the restraining members, e.g., the restraining member 28, is provided with an internally threaded bore for threadedly engaging the externally threaded shaft member 27.

The platform stabilizing/motive means 25 also includes drive means, as at 33 which preferably includes an electric motor 35, coupled to the threaded shaft member 27 for selectively causing the threaded shaft member 27 to be rotated about the longitudinal axis thereof thus driving the carriage assembly 21 or more specifically the platform 23 between the concealed/-stowed position and at least a first working position thereof, the first working position will be more clearly defined as the specification proceeds.

It should be understood that the desklike cabinet 13 per se depicts typical structure well known to those skilled in the art. Accordingly, the desklike cabinet 13 forms no particular part of the present invention other than to conveniently effect adequate disclosure of the present invention. Therefore, the present invention is not intended to be limited to the specific structure disclosed for the desklike cabinet 13. In view of the foregoing, it should be sufficient to simply state that the work surface 17 is defined by at least one horizontally disposed top member 36 and the cabinet 13 preferably includes a pair of side compartments 37, 39 defining a part a kneehole 41 disposed below the midportion of the work surface 17 as clearly shown in FIG. 1 of the drawings. Further, the cabinet 13 preferably includes base structure or legs 43 for supporting the side compartments 37, 39 a spaced distance above a supporting surface or floor.

The carriage assembly 21 preferably includes a pair of triangular shaped platelike members 34 which respectively carry the restraining members 30, 32, as clearly shown in FIG. 3 of the drawings for one of the platelike members 34. More specifically, each platelike member carries an upper restraining member 32 and a lower restraining member 32' even though only one plate-like member 34 may be thusly viewed in the drawings. The plate-like members 34 are joined along the vertical or rearward sides, i.e., the sides adjacent to the restraining members 30, 32, by a back plate member 38 and along the forward sides by an angleiron member 40. The upper ends of the platelike members 34 preferably include outwardly directed flange portions as at 34a(FIG. 2) to provide more rigidity to the carriage assembly 21. The flange portions 34a are attached to the platform 23 in any well known manner such as screws 42.

Figure 7:
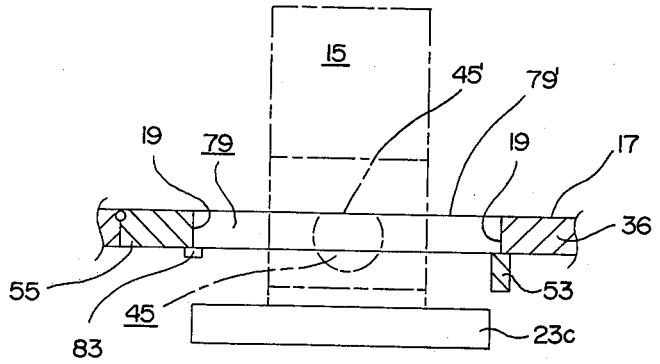
FIG. 7 is a partial view of structure similar to that depicted in FIGS. 3 and 6 to depict the sewing machine head in a flatbed sewing position.

Particular attention is now directed towards FIGS. 1 and 7 of the drawings wherein the working positions of the carriage assembly 21 are clearly illustrated. More specifically, FIG. 1 illustrates the platform 23 raised to an aligned position with the work surface 17 to accommodate free arm or open arm sewing, i.e., the sewing machine head 15 preferably is of the type which includes the well-known free arm 45 for sewing tubular structure such as sleeves normally found in a garment. It should be understood that the above-described free arm position corresponds to the previously mentioned working position for the carriage assembly. However, various positions for the carriage assembly 21 may hereinafter be conveniently reflected in connection with the positions of the platform 23, i.e., the previously mentioned concealed/stowed position 21' may more conveniently be referred to as the concealed/-stowed position **23*a* for the platform 23, the first working position or free arm position for the carriage assembly 21 may be conveniently referenced in connection with the platform by the numeral 23*b*, and a second working position for the carriage assembly 21 or flatbed position thereof may more conveniently be reflected in connection with the position of the platform being in the position 23*c*. FIG. 7 of the drawings clearly shows the second working position or flatbed position for the platform 23*c*. More specifically, the carriage assembly 21 and the platform 23 are raised to a predetermined height immediately beneath the work surface 17 thus establishing the second working position or flatbed position 23*c* of the carriage assembly. It should be pointed out that the platform 23 substantially fills the head opening 19 when in a position 23*b*. Conversely, certain structure yet to be disclosed is incorporated to fill the head opening 19 when the platform is in the flatbed position 23*c***.

Figure 2:
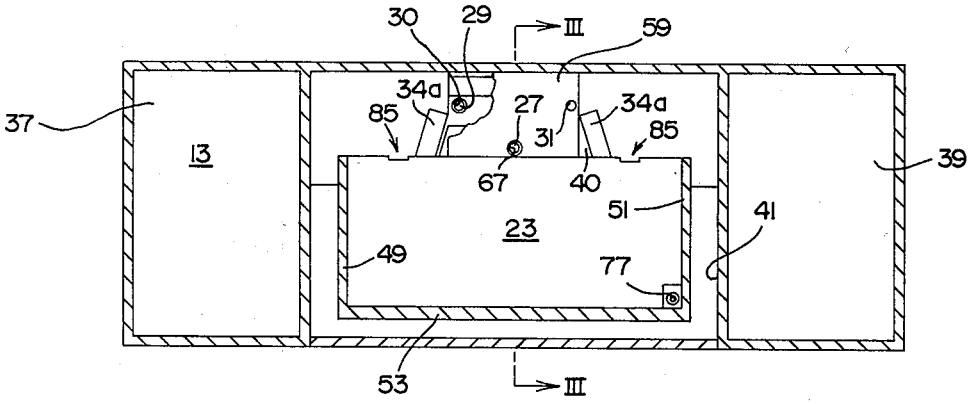
FIG. 2 is a sectional view taken as on the line II—II of FIG. 1

From FIGS. 1 through 3 of the drawings it may clearly be seen that the power lift 11 includes guard means 47 juxtaposed with the head opening 19 and extending a predetermined distance downwardly therefrom for precluding the likelihood of certain objects, e.g., fingers or hands of the operator, inadvertently protruding into the head opening 19 and becoming pinched between the work surface 17 (or more specifically the top member 36) and the platform 23 as the platform 23 is moved into the second working position **23*b*. More specifically, the guard means 47 includes a plurality of platelike members 49, 51, 53 which are fixedly attached to the underneath surface of the top member 36 as with adhesives or the like and which define the lower reaches of three sides of the opening 19. It will be appreciated by those skilled in the art that the usual flap member, as at 55, which defines the backside of the opening 19, is free to swing up to a position characterized in FIG. 3 of the drawings by the numeral 55a. Therefore, any objects or fingers wedged between the platform 23 and the flap member 55 while the platform 23 is in the process of being raised to the second position 23*b* would simply cause the flap member 55 to pivot upwardly to the position 55*a*** thus avoiding any pinching action thereof.

From FIGS. 1 through 3 of the drawings it may also be seen that the platform stabilizing/motive means 25 or more specifically the plurality of upright shaft members includes a pair of parallel spaced apart rod members, e.g., the previously mentioned upright shaft members 29, 31. The rod members 29, 31 are fixedly attached to the cabinet 13 or more specifically to a frame 57 in any wellknown manner as by welding or the like. It should be understood that the frame 57 includes upper and lower horizontally disposed confrontingly arranged platelike member 59, 61 joined one to the other by a vertical platelike member 63 with the remote ends of the rod members 29, 31 being fixedly attached to the confronting platelike members 51, 61 in the described manner. Additionally, the plurality of restraining members alluded to above includes a pair of guide sleeves, e.g., the restraining members 30, 32 constituting the guide sleeves, slidably engaging the respective pair of guide rod members 29, 31.

The electric powered motor 35 preferably is of the well known reversible type having a driven output drive shaft 65 coupled to the lower end 27' of the elongated externally threaded upright shaft member 27 with the upper end thereof 27'' being journaled to the cabinet 13 or more specifically the frame 57 by a bearing 67 or the like. The lower end 27' of the shaft 27 is suitably attached to the output shaft 65 in any well known manner as with a set screw 69 or the like. Accordingly, rotation of the drive shaft 65 in one direction is effective to raise the carriage assembly 21 or the platform 23 while rotation of the drive shaft 65 in a direction which is opposite to the one direction thereof is effective to lower the carriage assembly 21 or the platform 23. The drive means 33 also includes electric means 71 as clearly shown in FIG. 9 of the drawings for selectively causng the electric powered reversible motor 35 to be cyclically energized in forward and reverse directions to drive the carriage assembly 21 or the platform 23 between the concealed/stowed position **23*a* and the previously mentioned first and second working positions 23*b*/23*c*.**

Figure 9:
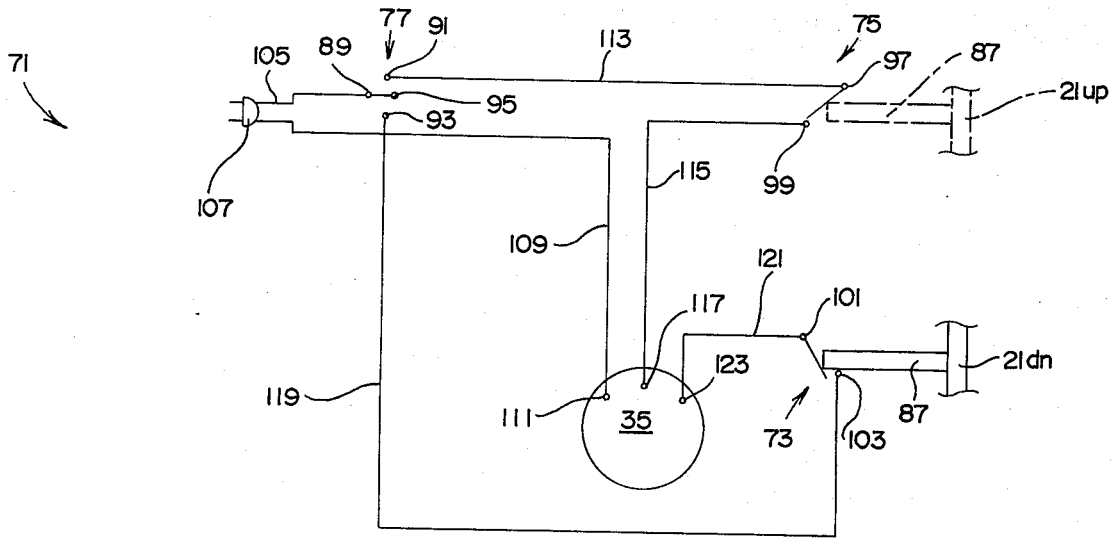
FIG. 9 is a schematic showing the electrical connections for the power lift arrangement.

From FIGS. 1 and 9 of the drawings it may clearly be seen that the electric means 71 includes a lower limit switch 73 for causing the motor 35 to become de-energized as the carriage assembly 21 or the platform 23 reaches the concealed/stowed position 23a.

Additionally, the electric means 71 includes an upper limit switch 75 for causing the motor 35 to become de-energized as the carriage assembly 21 (or more specifically the platform 23) is raised to an aligned position with the work surface 17 as shown in FIG. 1 by the numeral **23*b*, thus coinciding with the first of the previously mentioned and fully described working position of the platform 23.**

Figure 8:
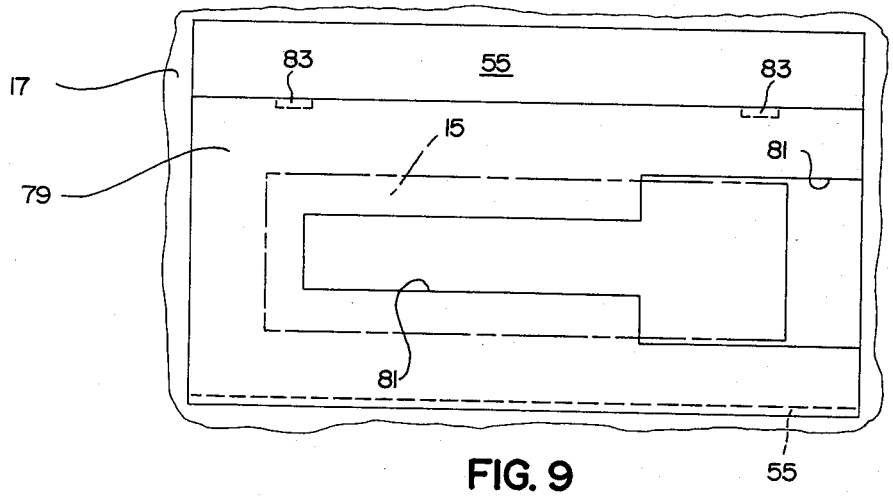
FIG. 8 is a partial top plan view of the cabinet of the present invention showing a platelike plug member used in conjunction with the flatbed sewing position.

Further, the electric means 71 includes manually operated switch means 77 for selectively causing the motor 35 to become de-energized as the carriage assembly 21 and the platform 23 are raised to a predetermined height immediately beneath the work surface 17, as clearly shown in FIG. 7, thus establishing the previously described second working position **23*c* of the platform The sewing machine or power lift 11 includes a platelike plug member 79 as best shown in FIGS. 7 and 8 of the drawings, for selectively fitting into and thus occluding at least in part the head opening 19, i.e., in a manner about to be fully disclosed. FIGS. 1 and 7 clearly show the free arm 45 disposed a spaced distance above the platform 23. Accordingly, the platelike plug member 79 is provided with a cut out portion as at 81 thus establishing a horseshoe-liked shape thereto for reaching around and contiguously engaging at least a portion of the free arm 45 as clearly shown in FIGS. 7 and 8 of the drawings. In other words, the upper surface, as at 45', of the free arm 45 and the upper surface, as at 79' of the platelike plug member 79 may be aligned one with the other and jointly with the work surface 17 as the platform 23 is moved into the second working position 23*c*** thereof.

It should be mentioned that the platelike plug member 79 is supported along one side thereof, when placed in the opening 19, by an offset portion of the previously mentioned member 53 as clearly shown in FIGS. 7, i.e., the member 53 being one of the several members constituting the previously disclosed guard means 47. The opposite side of the plug member 79 is supported by a plurality of rest plate or tab members, like the tab member 83 in FIG. 7, i.e., the tab members 83 are fixedly attached to the underneath surface of the flap member 55 in any well known manner as with screw structure (not shown) or the like. Accordingly, it will be appreciated that the platform 23 is provided with a plurality of notches as at 85 in FIG. 2, to enable the platform 23 to bypass or move upwardly past the tab members 83, i.e., when moving to the previously mentioned first working position **23*b* as shown in FIG. 1,**

It should be understood that the power lift 11 in its final or production form will include suitable guard or shroud structure (not shown) conveniently disposed within the knee-hole 41 to protect the operator against inadvertent contact with any of the above described operative structure.

Particular attention is now directed toward FIG. 9 of the drawings wherein it may be seen that the lower and upper limit switches are operated in a manner to be fully disclosed by fingerlike structure, as at 87, fixedly attached to the carriage assembly 21. The manually operated switch 77 is of the well known single pole double throw type having a neutral position, i.e., the switch 77 includes four terminals 89, 91, 93, 95.

Additionally, the upper limit switch 75 includes a pair of terminals 97, 99 and the lower limit switch 73 includes a pair of terminals 101, 103. One end of a conductor 105 is connected to the terminal 89 and the other end thereof is connected to a male plug 107. One end of a conductor 109 is connected to the male plug 107 and the other end thereof is connected to a common terminal 111 of the motor 35. One end of a conductor 113 is connected to the terminal 91 and the other end thereof is connected to the terminal 97. One end of a conductor 115 is connected to the terminal 99 and the other end thereof is connected to a terminal 117 for the motor 35. One end of a conductor 119 is connected to the terminal 93 and the other end thereof is connected to the terminal 103. One end of a conductor 121 is connected to the terminal 101 and the other end thereof is connected to a terminal 123 for the motor 35.

The electric means 71 is placed into operation by suitably engaging the male plug 107 with any convenient wall outlet or the like. The switch 77 disables the entire electric means 71 when the switch bar interconnects the terminals 89, 95. The limit switches 73, 75 are utilized in the normally closed positions, therefore, engagement of the switches 73, 75 with the fingerlike structure 87 is effective to open the switches as shown for the switch 73.

Placing the switch 77 in the up position, i.e., closing the contacts 89, 91, is effective to complete the circuit through the conductors 105, 113, thence through the closed contacts 97, 99, thence through the conductor 115, and thence through the common conductor 109 thus energizing the motor 35 in the suitable direction. This causes the carriage assembly 21 to be moved upwardly to the position shown in phantom lines in FIG. 9 and characterized therein by the numeral "21 up". It should be understood that when the carriage assembly reaches the position 21 up the contacts 97, 99 are opened by the fingerlike structure 87.

Conversely, placing the switch 77 in the down position, i.e., closing the contacts 89, 93, is effective to complete the circuit through the conductors 105, 119, thence through the closed contacts 101, 103, then through the conductor 121, and thence through the common conductor 109, thus energizing the motor 35 in the reverse direction. This causes the carriage assembly to be driven downwardly to the position "21 dn". Thus the fingerlike structure 87 engages the limit switch 73 opening the contacts 101, 103. It should be pointed out that the platform 23 automatically stops in the previously mentioned positions 23a, 23b. On the other hand, the platform 23 is manually stopped in the position 23*c* by simply operating the switch 77 to the off position, i.e., the switch bar closing the contacts 89, 95.

DESCRIPTION OF THE ALTERNATE EMBODIMENT

Figure 4:
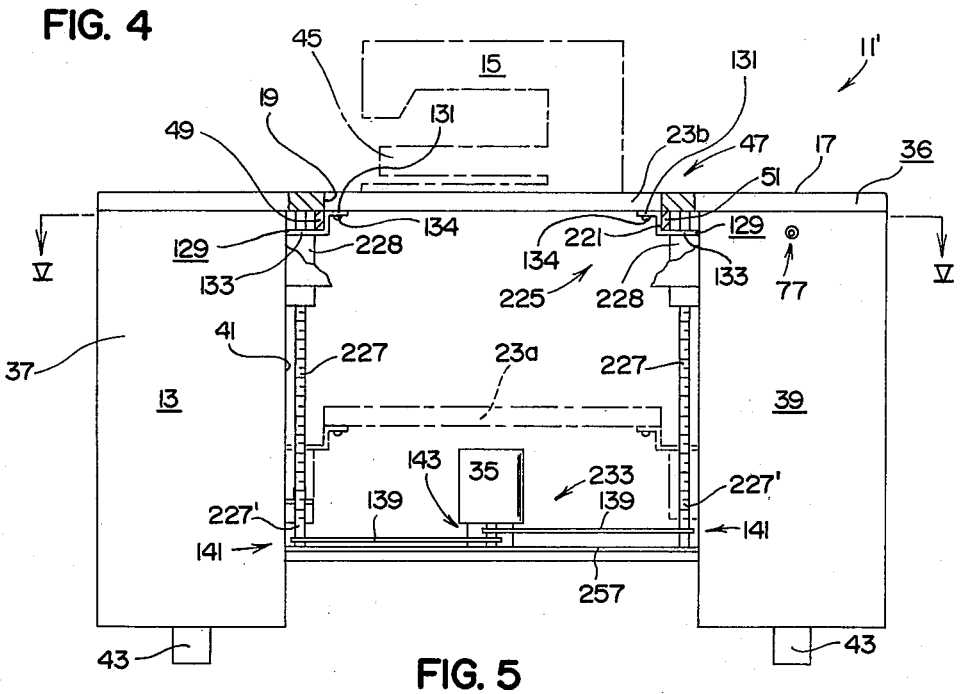
FIG. 4 is a view similar to FIG. 1 to depict an alternate embodiment of the present invention.
Figure 5:
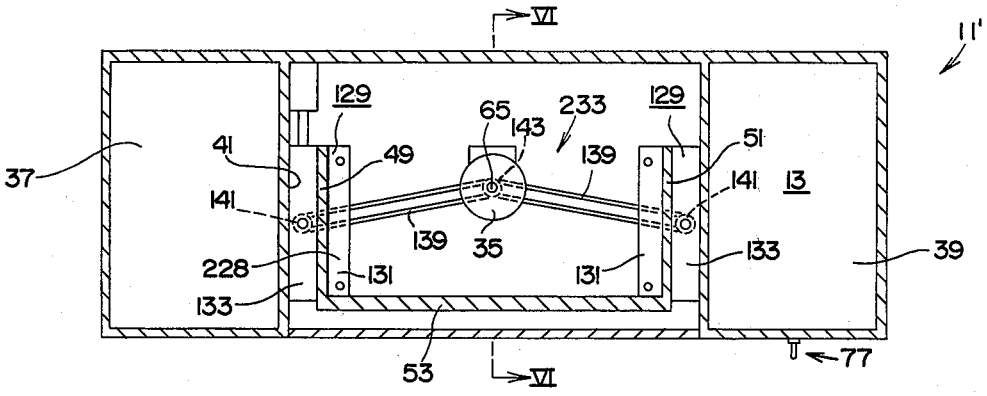
FIG. 5 is a sectional view taken as on the line V—V of FIG. 4.
Figure 6:
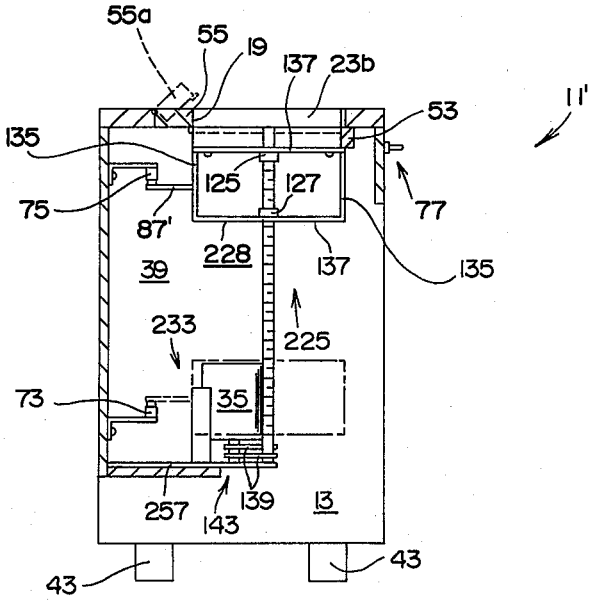
FIG. 6 is a sectional view taken as on the line VI—VI of FIG. 5 with the movable structure being depicted in phantom lines.

An alternate embodiment of the power lift herein disclosed is shown in FIGS. 4 through 6 of the drawings and is character referenced therein by the numeral 11'. The alternate embodiment 11' for the power lift differs only slightly from the principal embodiment 11 thereof. Accordingly, the following brief disclosure is directed towards these differences. Further, structure illustrated in the alternate embodiment which is identical to that ilustrated in the principal embodiment will be characterized by like numerals. On the other hand, structure which differs slightly from the principal embodiment will be characterized for the alternate embodiment by 200 series numerals which have the last two numerals corresponding to similar structure, while structure which differs significantly from the principal embodiment will be identified by totally peculiar numerals. From FIG. 4 of the drawings it may clearly be seen that the plurality of elongated upright shaft members includes a pair of externally threaded mandrels 227 having the respective remote ends thereof journaled to the cabinet 13 (or to suitable frame structure as at 257) preferably utilizing bearing structure (not shown) like the bearing 67 for the principal embodiment.

The plurality of restraining members for this embodiment includes a pair of yoke elements 228 respectively including upper and lower internally threaded stabilizing control members 125, 127 threadedly engaging the respective pair of externally threaded mandrels 227. From the above disclosure it should now be apparent to those skilled in the art that the alternate embodiment per se includes considerable duplicate structure, i.e., the pair of threaded mandrels 227, the pair of yoke elements 228, and the pairs of upper and lower internally threaded stabilized control members 125, 127. Accordingly, the disclosure herein for one of each of these duplicated structural components will be intended to be applicable to the other. Additionally, each of the mandrels 227 is threadedly engaged with both upper and lower stabilizing control members 125, 127 as clearly shown in FIG. 6 of the drawings. Further, each yoke element 229 is fixedly attached to the carriage assembly 221 whereby proper rotation of the mandrels 227 is effective to selectively raise and lower the carriage assembly 221. Also, it should be pointed out that the carriage assembly 221 includes the platform 23 supported by a pair of elongated offset members 129 respectively having inwardly directed flange members 131 which support the platform 23 and outwardly directed flange members 133 which have the respective pair of yoke elements 228 fixedly attached thereto as by welding or the like. The flange members 131 are attached to the platform 23 in any well known manner as by screws 134.

Each of the yoke elements 228 includes boxlike structure comprising a pair of vertical structural members 135 joined at the remote ends thereof by a pair of horizontal structural members 137 into a rigid box-like structure. The internally threaded stabilizing control members 125, 127 are fixedly attached as by welding or the like to the respective pair of horizontal structural members 137.

The drive means 223 includes a pair of endless belt or chain members 139 which couple the driven output shaft 65 of the motor 35 with the mandrels 227. More specifically, a pair of pulleys or sprockets 141 are fixedly attached to the respective lower ends 227' of the mandrels 227 in any well known manner as by welding or the like. Additionally, a double pulley or sprocket 143 is fixedly attached to the driven output shaft 65 in any well known manner as with a set screw not shown. Accordingly, the endless belt or chain members 139 suitably engage the respective pulley or sprocket members 141 and the double pulley or sprocket 143. From the foregoing it may clearly be seen how the electric means 71 selectively causes the electric powered reversible motor 35 to be cyclically energized in forward and reverse direction to properly drive the mandrels 227 in unison to raise and lower the platform 23 in like manner as previously described.

Although the invention has been described and illustrated with respect to preferred embodiments thereof, it is to be understood that it is not to be so limited since changes and modifications may be made therein which are within the full intended scope of the invention.

I claim:

1. In a sewing machine of the type having a desklike cabinet, a concealable sewing machine head, and a horizontally disposed work surface provided with a head opening through which the sewing machine head may freely be passed; the improvement which comprises a carriage assembly including a platform having a size and shape complementary with said head opening for restingly supporting thereon the sewing machine head, said carriage assembly being movable between a concealed/stowed position beneath said work surface and at least one working position wherein a cooperative association of said sewing machine head and said work surface is established, and platform stabilizing-/motive means for guidingly constraining said carriage assembly through the movement thereof and for selectively driving said carriage assembly between said concealed/stowed position and said working position; said platform stabilizing/motive means including a plurality of elongated upright shaft members, a plurality of restraining members for restrainedly coupling said carriage assembly with said respective plurality of shaft members, at least one of said shaft members being provided with external threads substantially along the length thereof, at least one of said restraining members being provided with an internally threaded bore for threadedly engaging said externally threaded shaft member, and drive means coupled to said threaded shaft member for selectively causing said threaded shaft member to be rotated about the longitudinal axis thereof thus driving said carriage assembly between said concealed/stowed position and said working position.

2. The sewing machine as set forth in claim 1 in which is included guard means juxtaposed with said head opening and extending a predetermined distance downwardly therefrom for precluding the likelihood of certain objects inadvertently protruding into said head opening and becoming pinched between said work surface and said platform as said platform is moved into said working position.

3. The sewing machine as set forth in claim 1 in which said platform stabilizing/motive means includes frame means, and in which said plurality of elongated upright shaft members includes a pair of parallel spaced apart guide rod members having the remote ends thereof fixedly attached to said frame means, and in which said plurality of restraining members includes a pair of guide sleeves slidably engaging said respective pair of guide rods.

4. The sewing machine as set forth in claim 1 in which said drive means includes an electric powered reversible motor having a driven output drive shaft coupled to the lower end of said elongated externally threaded upright shaft member with the upper end thereof being journaled to said cabinet whereby rotation of said drive shaft in one direction is effective to raise said carriage assembly while rotation of said driven shaft in a direction which is opposite to said one direction thereof is effective to lower said carriage assembly, and electric means for selectively causing said electric powered reversible motor to be cyclically energized in forward and reverse directions to drive said carriage assembly between said concealed/stowed position and said working position.

5. The sewing machine as set forth in claim 4 in which said electric means includes a lower limit switch for causing said motor to become de-energized as said carriage assembly reaches said concealed/stowed position.

6. The sewing machine as set forth in claim 4 in which said electric means includes an upper limit switch for causing said motor to become de-energized as said platform is raised to an aligned position with said work surface thus coinciding with one of said working positions of said platform.

7. The sewing machine as set forth in claim 6 in which said electric means includes manually operated switch means for selectively causing said motor to become de-energized as said carriage assembly and said platform are raised to a predetermined height immediately beneath said work surface thus establishing a second working position of said platform.

8. The sewing machine as set forth in claim 7 in which is included a platelike plug member for selectively fitting into and thus occluding at least in part said head opening, said sewing machine head including a free arm disposed a spaced distance above said platform, said plug member having a horseshoe-like shape thereto for reaching around and contiguously engaging at least a portion of said free arm whereby the upper surfaces of the free arm and said plug member may be aligned one with the other and jointly with said work surface as said platform is moved to said second working position thereof.

9. The sewing machine as set forth in claim 1 in which said plurality of elongated upright shaft members includes a pair of externally threaded mandrels having the respective remote ends thereof journaled to said cabinet, and said plurality of restraining members includes a pair of yoke elements respectively including upper and lower internally threaded stabilizing control members threadedly engaging said respective pair of externally threaded mandrels whereby each of said mandrels is threadedly engaged with both of said upper and lower stabilizing control members, said yoke elements being fixedly attached to said carriage assembly whereby simultaneous rotation of said mandrels is effective to selectively raise and lower said carriage assembly.

10. The sewing machine as set forth in claim 9 in which said drive means includes an electric powered reversible motor having a driven output drive shaft and means for coupling said drive shaft to the lower ends of said pair of elongated externally threaded upright mandrels whereby rotation of said drive shaft in one direction is effective to simultaneously rotatably drive said mandrels in one direction thus raising said carriage assembly and rotation of said drive shaft in a direction which is opposite to said one direction thereof is effective to simultaneously rotatably drive said mandrels in a direction which is opposite to said one direction thereof thus lowering said carriage assembly, and electric means for selectively causing said electric power reversible motor to be cyclically energized in forward and reverse directions to drive said platform between said concealed/stowed position and said working position thereof.

11. The sewing machine as set forth in claim 10 in which said electric means includes a lower limit switch for causing said motor to become de-energized as said carriage assembly reaches said concealed/stowed position.

12. The sewing machine as set forth in claim 10 in which said electric means includes an upper limit switch for causing said motor to become de-energized as said platform is raised to an aligned position with said work surface thus coinciding with one of said working positions of said platform.

13. The sewing machine as set forth in claim 12 in which said electric means includes manually operated switch means for selectively causing said motor to become de-energized as said carriage assembly and said platform are raised to a predetermined height immediately beneath said work surface thus establishing a second working position of said platform.

14. The sewing machine as set forth in claim 13 in which is included a platelike plug member for selectively fitting into and thus occluding at least in part said head opening, said sewing machine head including a free arm disposed a spaced distance above said platform, said plug member having a horseshoe-like shape thereto for reaching around and contiguously engaging at least a portion of said free arm whereby the upper surfaces of the free arm and said plug member may be aligned one with the other and jointly with said work surface as said platform is moved to said second working position thereof.

* * * * *